United States Patent [19]

Belcher, Jr. et al.

[11] 4,286,542

[45] Sep. 1, 1981

[54] LIQUID IMMERSION APPARATUS FOR MINUTE ARTICLES

[75] Inventors: Jewell G. Belcher, Jr.; Ben R. Hollis, Jr., both of Huntsville, Ala.

[73] Assignee: The United States of America as represented by the Administrator of the National Aeronautics and Space Administration, Washington, D.C.

[21] Appl. No.: 171,933

[22] Filed: Jul. 18, 1980

[51] Int. Cl.[3] ..... B05C 3/02

[52] U.S. Cl. ..... 118/423; 118/500; 134/137

[58] Field of Search ..... 118/500, 423, 400, 425; 427/2, 4; 134/85, 92, 117, 135, 137, 201; 204/297 R; 156/662

[56] References Cited

U.S. PATENT DOCUMENTS

| | | | |
|---|---|---|---|
| 1,883,669 | 10/1932 | Ford | 118/425 |
| 2,837,055 | 6/1958 | Whitehead | 118/500 |
| 3,168,100 | 2/1965 | Rich | 134/137 |
| 3,479,196 | 11/1969 | Heimann | 118/500 |

*Primary Examiner*—Ralph S. Kendall

*Attorney, Agent, or Firm*—J. H. Beumer; J. R. Manning; L. D. Wofford, Jr.

[57] ABSTRACT

Apparatus is disclosed for immersing minute integrated circuit chips in an etching solution in manufacturing integrated circuits during research and development. The apparatus includes holder member C having a handle 24 and basket support 26 for carrying a removable unitary basket A and lid structure B wherein fluid flow-through passages 20 are formed and wherein graduated openings 28 in the handle provide for adjustably supporting the basket in a beaker at a desired level.

4 Claims, 2 Drawing Figures

LIQUID IMMERSION APPARATUS FOR MINUTE ARTICLES

ORIGIN OF THE INVENTION

The invention described herein was made by an employee of the U.S. Government and may be manufactured and used by or for the Government for governmental purposes without the payment of any royalties thereon or therefor.

BACKGROUND OF THE INVENTION

In the research and development of integrated circuit chips, a small number of such chips are manufactured at a time requiring that the individual chips be immersed in a solution for etching. Heretofore, the individual chips have been dispersed in the liquid without being contained which requires that they be retrieved by means of tweezers and like equipment. The handling of the chips in this manner can cause damage to the circuitry formed thereon and subsequent delay and expense in the experimentation.

SUMMARY OF THE INVENTION

It has been found, according to the invention, that apparatus for immersing integrated circuit chips in an etching solution can be had by providing a handle portion having graduated openings formed along the length thereof and an annular support and retaining portion formed adjacent one end thereof for receiving a basket in which the chips may be contained. The basket is provided with fluid passages in bottom and side portions and a lid is provided having fluid passages preventing air pocket formation and allowing complete filling and circulation of the solution. The chips may be completely immersed in the etching solution and supported at a desired height avoiding loss of the chips and unnecessary handling. The entire assembly is made from a suitable acid resistant material such as Teflon.

Accordingly, an important object of the present invention is the provision of apparatus for containing and immersing minute integrated circuit chips in an etching solution.

Another important object of the present invention is the provision of apparatus of simple economic construction for immersing minute integrated circuit chips wherein perforated basket and lid members are formed from a corrosive resistant friction material to provide a fitted unitary structure containing the chips against buoyancy while allowing complete flow through of the etching solution.

Yet another important object of the present invention is to the provision of apparatus for adjustably positioning minute integrated circuit chips completely immersed in an etching solution wherein adjustment is provided by simple reliable means.

DESCRIPTION OF FIGURES

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The invention relates to apparatus for immersing minute integrated circuit chips in an etching solution wherein the apparatus includes a basket member A having an open top and side and bottom walls with a plurality of minute fluid passages formed in the side and bottom walls. A removable lid member B encloses the open top of the basket member having a plurality of minute fluid passages formed therein. The fluid passages are dimensioned to overcome buoyancy while allowing complete circulation of the solution through the basket. The basket and lid members are constructed of a non-corrosive friction material and are dimensioned relative to one another to afford a frictional fitting therebetween whereby said lid and basket members are fitted as a unitary structure containing said chips against buoyancy while the passages allow flow through of said solution when immersed therein. A holder member includes an upstanding handle portion and a basket support means carried adjacent one end of the handle portion for supporting and retaining the basket member during immersion. The handle portion includes a plurality of vertically spaced attachment means for adjustably securing the holder assembly to associated structure whereby the basket member may be supported in the solution at a desired level.

Figure 1:
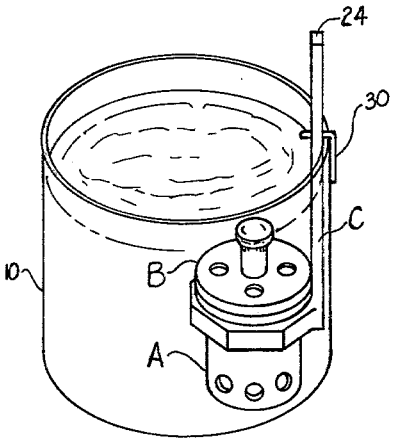
FIG. 1 is a perspective view illustrating apparatus constructed according to the invention for immersing minute integrated circuit chips with parts cut away.
Figure 2:
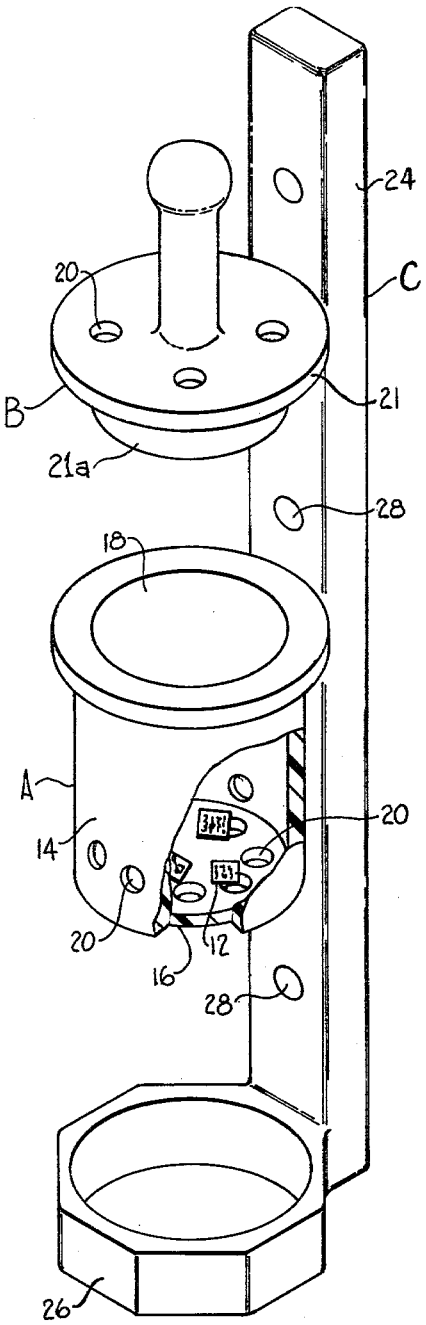
FIG. 2 is a perspective view of apparatus constructed according to the invention for immersing minute integrated circuit chips in an etching solution with parts thereof separated.

Referring now in more detail to FIG. 1, the apparatus is illustrated as being secured to the edge of a beaker 10 whereby the basket A is immersed and supported in the etching solution contained therein. A plurality of minute integrated circuit chips 12 are carried in the basket and are completely immersed for etching in the solution. As illustrated, the basket A is cylindrical in shape having circumferential side walls 14 and a bottom wall 16, and an open top portion 18. The side and bottom walls include a plurality of minute fluid passages 20 which are dimensioned to retain the minute chips 12 in the container against buoyancy while allowing complete flow through of the solution and complete immersion of the chips in the basket. The lid member B includes a cover for completely enclosing the open top 18 in the basket having identical minute fluid passages 20 formed therein which prevent air pockets and facilitate circulation of the solution in the basket while retaining chips which float with the solution to the top of the basket. In this manner, the basket is completely filled with solution to etch the chips while overcoming buoyancy.

The basket and lid members are preferably constructed from Teflon so as to be corrosive resistant. Lid B includes a flange 20 and a reduced plug portion **21*a* which is dimensioned to fit within the basket member in a frictional engagement keeping the lid tightly integral with the basket member during use. The basket member includes a circumferential flange 22 surrounding the basket coextending with flange 21** of the lid.

The holder member C includes upstanding handle portion 24 and a basket support means 26 which is in the form of an annular retaining ring which supports and retains the basket when immersed in the solution. The circumferential flange 22 rests on the top surface of the ring 26 and the basket A is dimensioned to have a tight frictional fit within the ring whereby the basket is retained and supported thereon. The handle portion C includes a plurality of spaced attachment means in the form of spaced openings 28 in which a removable insert member in the form of an "L" shaped peg 30 may be received and secured to the edge of the beaker 10. In this manner, the holder member 24 may be positioned at a height relative to the edge of the beaker to maintain the basket in the etching solution at a desired level completely immersed.

While a preferred embodiment of the invention has been described using specific terms, such description is for illustrative purposes only, and it is to be understood that changes and variations may be made without departing from the spirit or scope of the following claims.

What is claimed is:

1. Apparatus for immersing minute integrated circuit chips in an etching solution comprising:

a basket member having an open top and side and bottom walls;

a plurality of minute fluid passages formed in said side and bottom walls of the said basket member;

a removable lid member for enclosing said open top of said basket member having a plurality of minute fluid passages formed therein preventing air pockets in said basket during use;

said fluid passages being dimensioned to retain said minute chips in said container against buoyancy and solution turbulence while allowing complete circulation of fluid through the interior of said basket and outwardly through said lid member;

said basket and lid members being constructed of a non-corrrosive frictional material and being dimensioned relative to one another affording a frictional fitting therebetween to provide a unitary structure whereby said lid member is retained on said basket member against fluid pressure during use;

a holder member including an upstanding handle portion;

basket support means carried adjacent one end of said handle portion for supporting and retaining said basket member for immersion; and said handle portion including a plurality of vertically spaced attachment means for adjustably securing said holder assembly to associated structure whereby said basket member is supported in said solution at a desired level therein.

2. The apparatus of claim 1 wherein said attachment means includes spaced openings formed in said handle portions and a removable insert member receivable in said openings, said insert member being attachable to said solution container.

3. The apparatus of claim 2 wherein said basket support means includes an annular retaining ring and said basket member includes a circumferential flange for engaging said retaining ring whereby said basket is supported and retained thereon.

4. The apparatus of claim 1 wherein said basket, lid, and holder members are constructed of Teflon.

* * * * *